US009890031B2

(12) United States Patent
Jooste

(10) Patent No.: US 9,890,031 B2
(45) Date of Patent: Feb. 13, 2018

(54) ALCOHOLIC BEVERAGE BARREL DISPENSING APPARATUS

(71) Applicant: LJ Crafted Wines, La Jolla, CA (US)

(72) Inventor: Lowell Jooste, La Jolla, CA (US)

( * ) Notice: Subject to any disclaimer, the term of this patent is extended or adjusted under 35 U.S.C. 154(b) by 0 days.

(21) Appl. No.: 15/266,395

(22) Filed: Sep. 15, 2016

(65) Prior Publication Data

US 2017/0081167 A1 Mar. 23, 2017

Related U.S. Application Data

(60) Provisional application No. 62/220,146, filed on Sep. 17, 2015.

(51) Int. Cl.

| | |
|---|---|
| ***B67D 3/00*** | (2006.01) |
| ***B67D 3/04*** | (2006.01) |
| ***B67D 1/04*** | (2006.01) |
| ***B67D 1/08*** | (2006.01) |

(52) U.S. Cl.

CPC ..... *B67D 3/04* (2013.01); *B67D 1/0412* (2013.01); *B67D 1/0829* (2013.01); *B67D 3/0048* (2013.01); *B67D 3/0064* (2013.01); *B67D 3/0093* (2013.01)

(58) Field of Classification Search

CPC .. B67D 1/0849; B67D 1/0848; B67D 1/0841; B67D 1/0831; B67D 1/0835; Y10T 137/314

See application file for complete search history.

(56) References Cited

U.S. PATENT DOCUMENTS

| | | | | | |
|---|---|---|---|---|---|
| 41,330 | A | | 1/1864 | Squarza | |
| 205,302 | A | | 6/1878 | Rousseau | |
| 327,401 | A | * | 9/1885 | Low | B67D 1/0832 222/400.7 |
| 381,436 | A | * | 4/1888 | Sherwood | B67D 1/0832 222/400.7 |
| 710,631 | A | * | 10/1902 | Tietz | B67D 1/0829 137/325 |
| 850,070 | A | * | 4/1907 | Spikes | B67D 1/0832 222/400.7 |
| 928,813 | A | * | 7/1909 | Spikes | B60K 15/04 137/588 |
| 1,303,814 | A | * | 5/1919 | Crane | B05B 9/0822 222/398 |
| 1,304,390 | A | * | 5/1919 | Abramovitz | B65D 47/061 137/321 |
| 1,338,007 | A | * | 4/1920 | Finley | B67D 1/0829 137/176 |
| 2,083,281 | A | * | 6/1937 | Spayd | B67D 1/0802 222/400.7 |
| 2,158,347 | A | * | 5/1939 | Yirava | B67D 1/0412 141/19 |
| 2,162,842 | A | * | 6/1939 | Dolison | B67D 1/0802 137/12.5 |
| 2,165,684 | A | | 7/1939 | Struck | |
| 2,547,084 | A | * | 4/1951 | Mareuse | B05B 7/2424 222/330 |

(Continued)

*Primary Examiner* — Paul R Durand
*Assistant Examiner* — Randall Gruby
(74) *Attorney, Agent, or Firm* — Lewis Kohn & Walker LLP; David M. Kohn; Kari Moyer-Henry

(57) ABSTRACT

An apparatus for dispensing an alcoholic beverage from a barrel without the risk of spoilage from oxidation and a method for installing the apparatus in a barrel.

8 Claims, 8 Drawing Sheets

(56) References Cited

U.S. PATENT DOCUMENTS

| | | | | | |
|---|---|---|---|---|---|
| 2,707,967 | A | * | 5/1955 | Adams | 137/212 |
| 3,115,150 | A | * | 12/1963 | Sariotti | B67D 1/0835 137/240 |
| 3,141,690 | A | * | 7/1964 | Greenfield | B67D 1/0802 137/212 |
| 3,240,392 | A | * | 3/1966 | Nicko | B67D 1/0829 222/82 |
| 3,315,844 | A | * | 4/1967 | Klasson | B67D 1/0412 137/212 |
| 3,403,820 | A | * | 10/1968 | Landis | B67D 1/0412 222/396 |
| 4,214,599 | A | * | 7/1980 | Astrom | B67D 3/04 137/15.16 |
| 4,523,698 | A | * | 6/1985 | Kienlein | B67D 1/0835 222/185.1 |
| 4,665,940 | A | * | 5/1987 | Jacobson | B65D 83/425 137/212 |
| 4,699,298 | A | * | 10/1987 | Grant | B67D 1/0829 222/400.7 |
| 4,759,462 | A | * | 7/1988 | Neglio | B65D 39/12 220/235 |
| 4,784,299 | A | * | 11/1988 | Stenger | B67D 1/0829 222/397 |
| 4,850,387 | A | * | 7/1989 | Bassill | B67D 1/0412 137/212 |
| 2013/0277396 | A1 | | 10/2013 | Daly | |

* cited by examiner

ALCOHOLIC BEVERAGE BARREL DISPENSING APPARATUS

FIELD OF INVENTION

The present invention pertains generally to devices for dispensing an alcoholic beverage. More particularly, the present invention pertains to an apparatus for dispensing an alcoholic beverage directly from a barrel.

It is well known among those in the wine industry as well as wine enthusiasts, that oxygen destroys wine ultimately turning it into vinegar. As a result, wine makers are typically very reluctant to remove a bung from a barrel or serve wine directly out of a barrel due to concern that oxygen as well as floating debris in the air will contaminate the wine thereby resulting in deterioration of the wine quality in the barrel, From the contamination side, if a winemaker is offering a barrel tasting to a group, he/she never knows what germs people may be carrying and thus affecting the wine in the barrel.

In order to draw samples from a barrel, a winemaker normally siphons the wine or uses a wine thief, which operates in the same way as a pipette. For example, http://morewinemaking.com/products/glass-wine-thief.html. This process involves removing the bung from the barrel hole, which allows oxygen into the wine. The same issues with oxidation plague other types of alcohol produced in barrels, including but not limited to, rum and whiskey.

There remains a need in the art for a dispensing apparatus for repeatedly dispensing an alcoholic beverage directly from a barrel. The present invention addresses this need and provides a solution for regularly dispensing an alcoholic beverage from the same barrel without oxygen/air entering the barrel.

In light of the above, it is an object of the present invention to provide the desired features described herein as well as additional advantages of providing an alcoholic beverage barrel dispensing apparatus that is capable of preserving the quality of the alcoholic beverage when opting for direct dispensing from the barrel,

SUMMARY OF THE INVENTION

The present invention is an apparatus for dispensing an alcoholic beverage directly from a barrel.

It is another object of the present invention to provide an apparatus for dispensing an alcoholic beverage from a barrel that is easy to use and easy to sterilize. In a preferred embodiment the dispensing apparatus is comprised of entirely food grade parts resulting in the apparatus being hygienic.

It is still another object of the present invention to provide an apparatus for dispensing an alcoholic beverage from a barrel wherein the bung hole of the alcoholic beverage barrel is sealed air tight preventing spoilage of the alcoholic beverage from oxygen and/or debris.

It is a further object of the present invention to provide an apparatus for dispensing an alcoholic beverage from a barrel that is simple to install and uninstall.

It is yet another object of the present invention to provide a method of installing an apparatus for dispensing an alcoholic beverage from a barrel.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar parts are identified with similar characters, and in which.

DETAILED DESCRIPTION OF THE INVENTION

Figure 1:
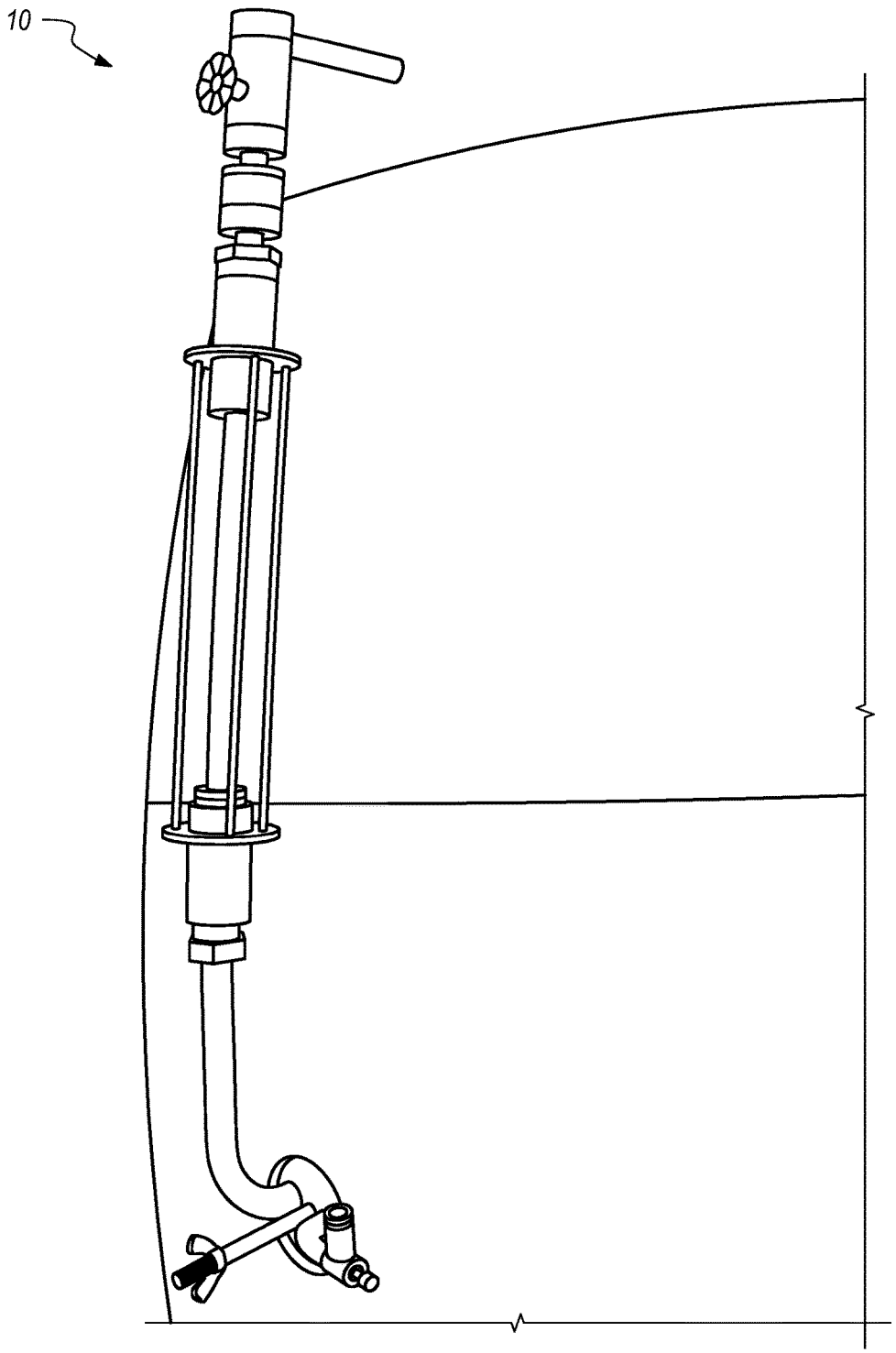
FIG. 1 illustrates the assembled and installed dispensing apparatus of the present invention.
Figure 2:
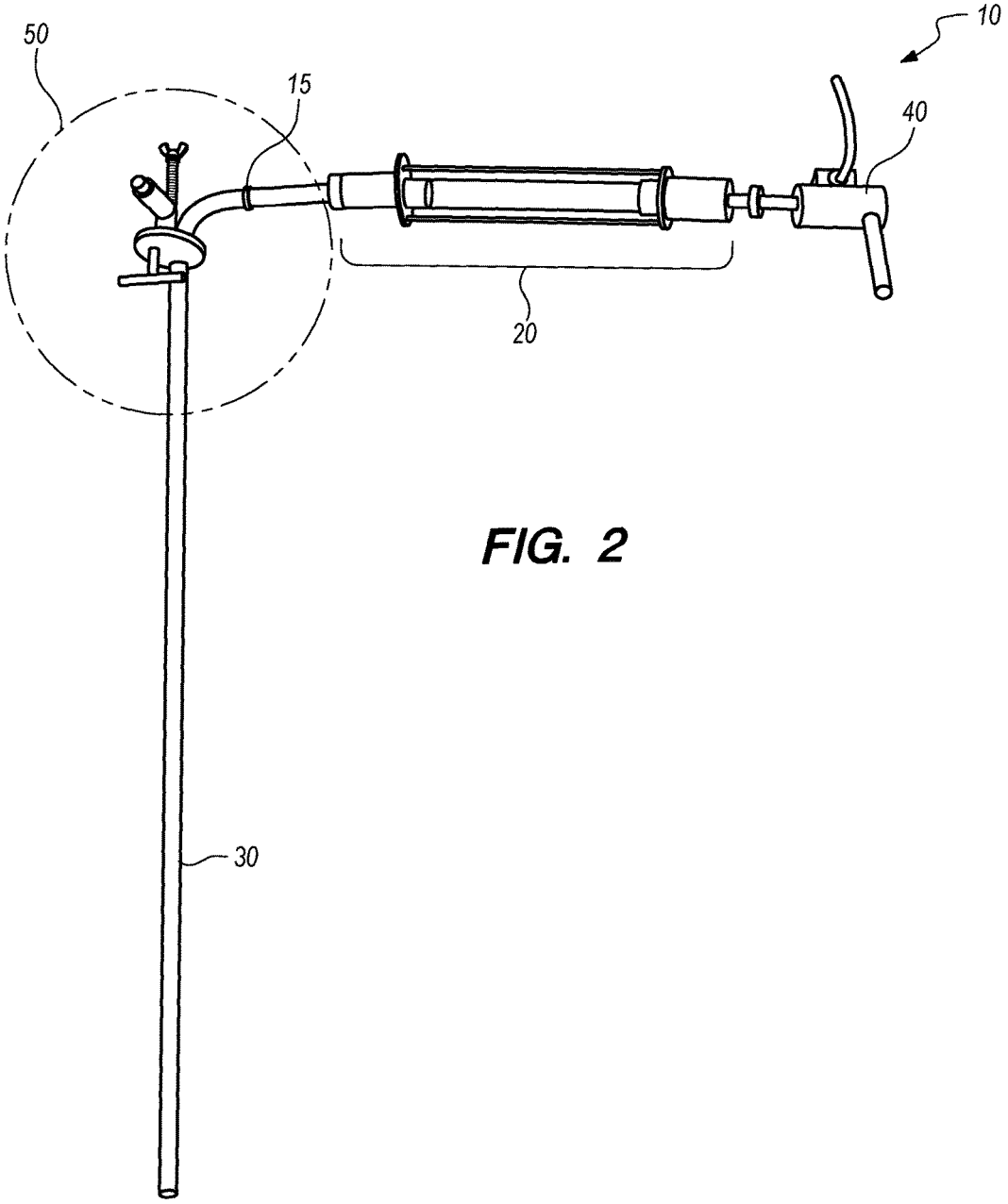
FIG. 2 illustrates the assembled dispensing apparatus of the present invention.

The dispensing apparatus 10 of the present invention is shown in FIG. 1. The dispensing apparatus 10 clamps into the existing bung hole of a barrel using its tapered shape thereby forming an air tight seal. The dispensing apparatus 10 forces an alcoholic beverage from the barrel by displacement by use of a stream of low pressure (i.e. 5 psi) inert gas into the barrel, With regard to FIG. 2, shown is the assembled dispensing apparatus 10 of the present invention. The dispensing apparatus 10 comprising a beverage pipe 30 for insertion into the barrel, the beverage pipe 30 having a first end and a second end wherein the first end is inserted into the barrel and the second end includes a T-piece, the T-piece being inserted into the barrel and positioned directly inside the bung hole. The dispensing apparatus 10 further includes a connector unit 50 having an O-ring 54 to ensure the connector unit 50 fits straggly in the bung hole. The external portion of the beverage pipe is comprised of a safety valve 15 and a sight glass 20 for observing the flow of the alcoholic beverage from the barrel when the faucet 40 is in the open position.

Figure 3:
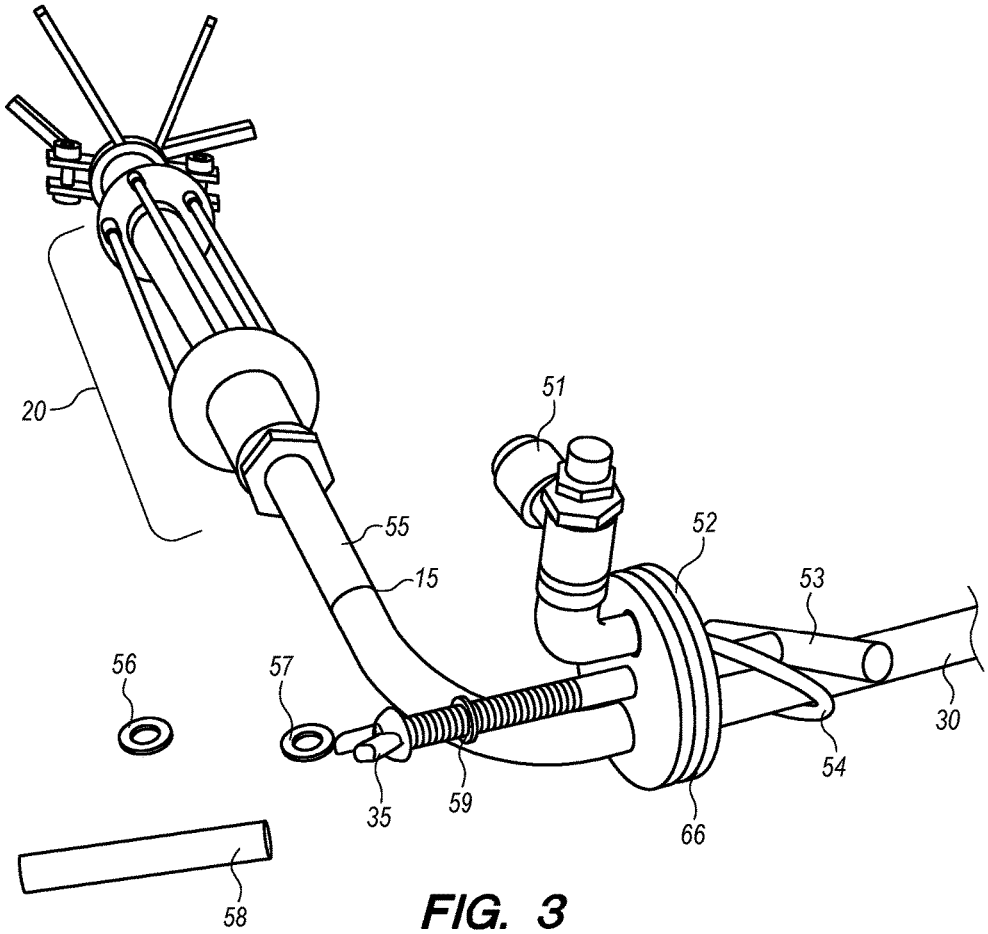
FIG. 3 illustrates a close up view of the connector unit of the present invention.
Figure 4:
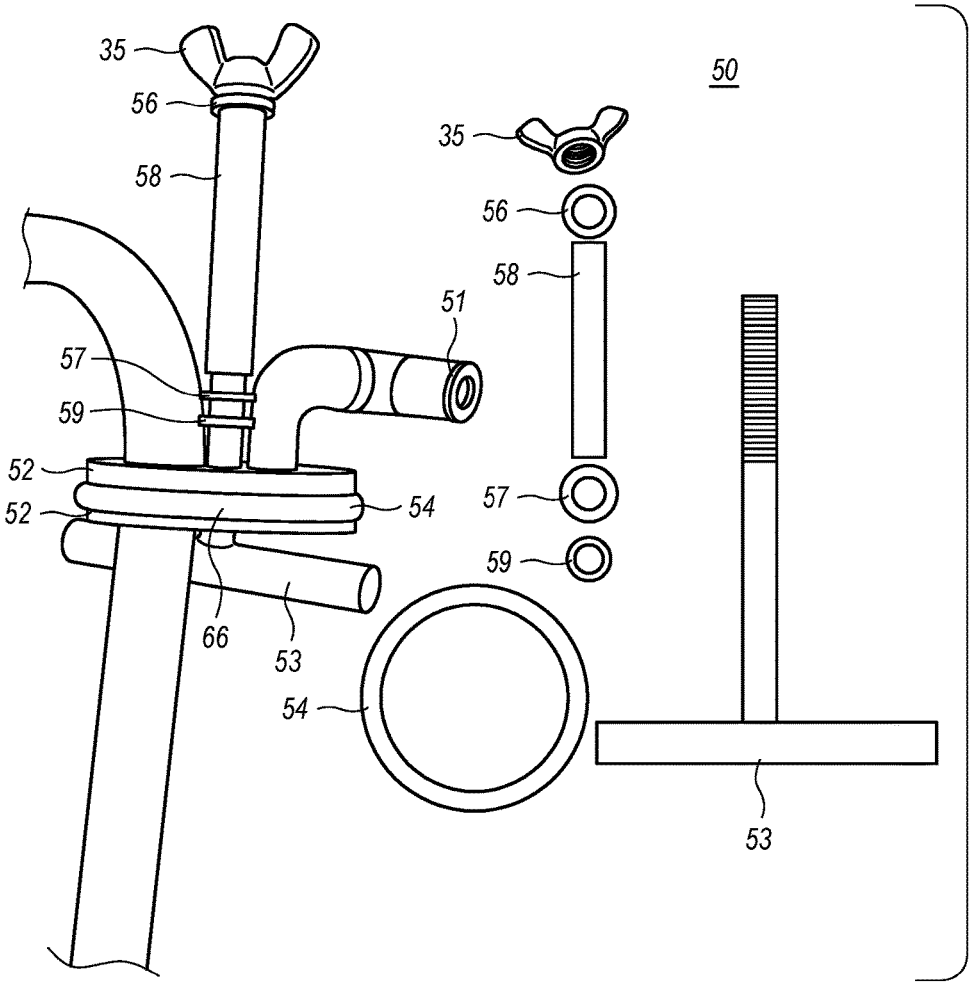
FIG. 4 illustrates the major components of the dispensing apparatus of the present invention.

With regard to FIGS. 3 & 4, shown are close-ups of the major components of the connector unit 50 of the dispensing apparatus 10 of the present invention. The connector unit 50 has a circular piece 52 of stainless steel (s/s) with a central channel 66, the central channel 66 having an O-ring 54 around it. In a preferred embodiment, the dimensions of O-ring 54 ensures the snug fit of the connector unit 50 in the barrel bung hole (not shown), The dimensions may be any inner diameter, outer diameter and thickness that achieves a snug fit with, the bung hole sealing inert gas under positive pressure inside the barrel. The T-piece 53 passes through a hole in the center of the circular piece 52, T-piece 53 then goes through the following in this order:
O-ring 59
S/s washer 57
S/s tube 58
S/s washer 56
S/s wing nut 35, When wing nut 35 is tightened, washer 57 squeezes O-ring 59 against the hole positioned in the middle of the circular piece 52 thereby forming an air seal so that inert gas cannot escape from the barrel through the circular piece 52 hole.

During the installation of the apparatus, the tube 58 is easily detached by removing the wing nut 35 and s/s washer 56. Circular piece 52 further includes an air flow control valve 51. wherein the inert gas is forced into the barrel in order to displace the alcoholic beverage during dispensing.

Figure 5:
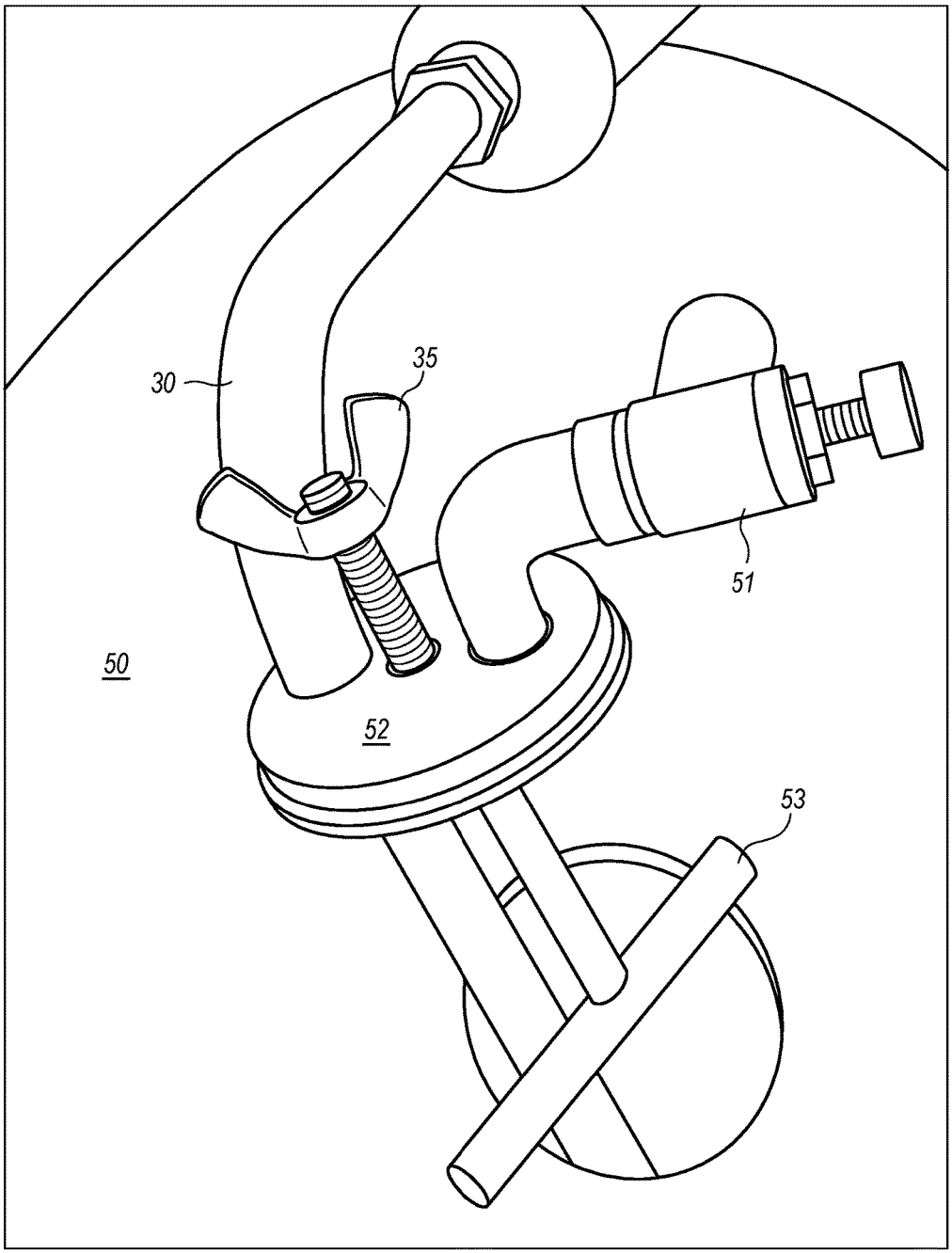
FIG. 5 illustrates the installation of the dispensing apparatus of the present invention.
Figure 6:
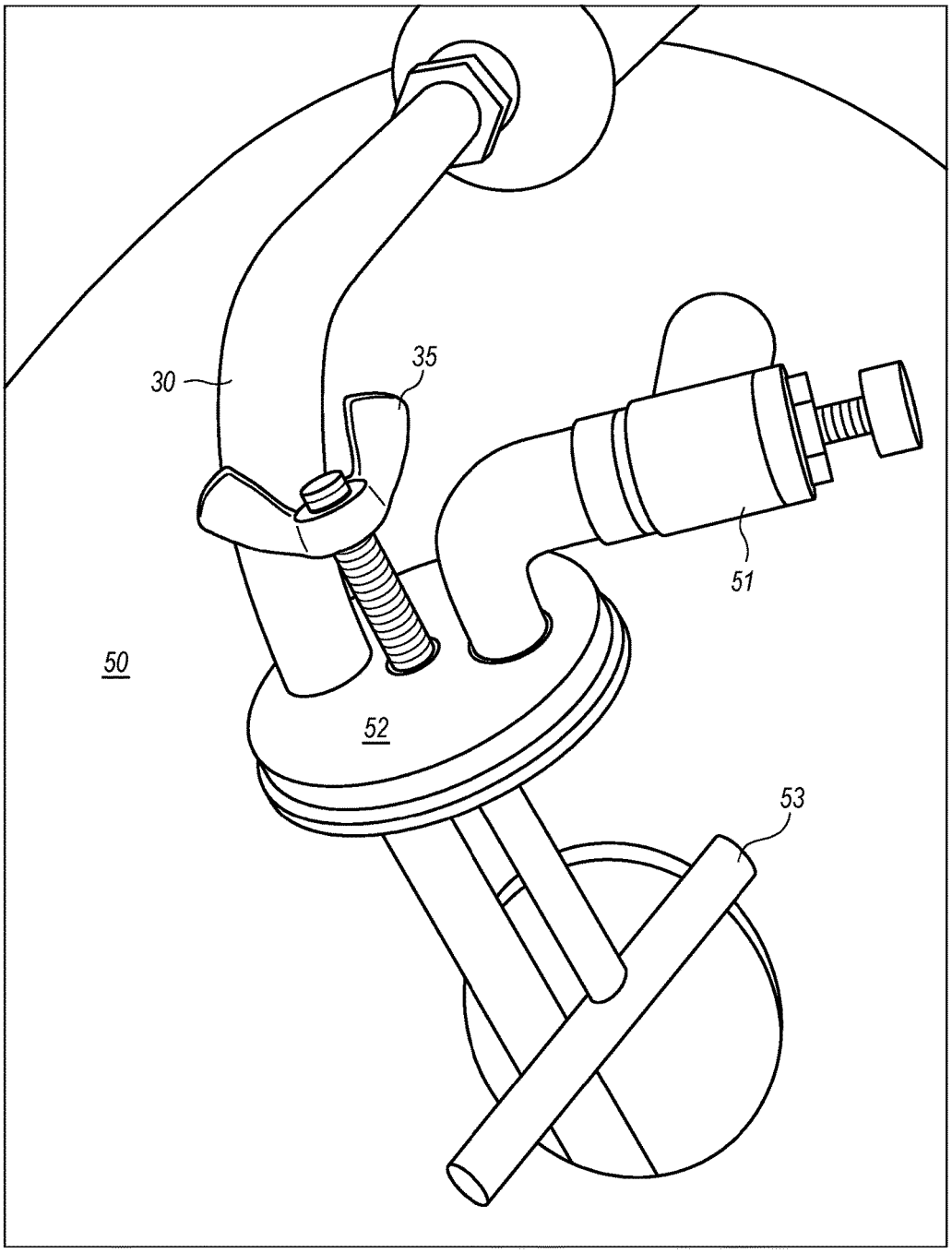
FIG. 6 illustrates a close up view of the installation of the dispensing apparatus of the present invention.

With regard to FIG. 5 and FIG. 6, shown are close ups of the connector unit 50 of the present. invention wherein the circular piece 52 further includes two holes positioned on either side of the central T-piece hole, the holes being opposite each other. The first hole secures the beverage pipe 30 in the circular piece 52 and the second hole secures the air flow control valve 51 in the circular piece 52. In an alternative embodiment, a pressure relief valve may be provided in place of the air flow control valve.

Figure 7:
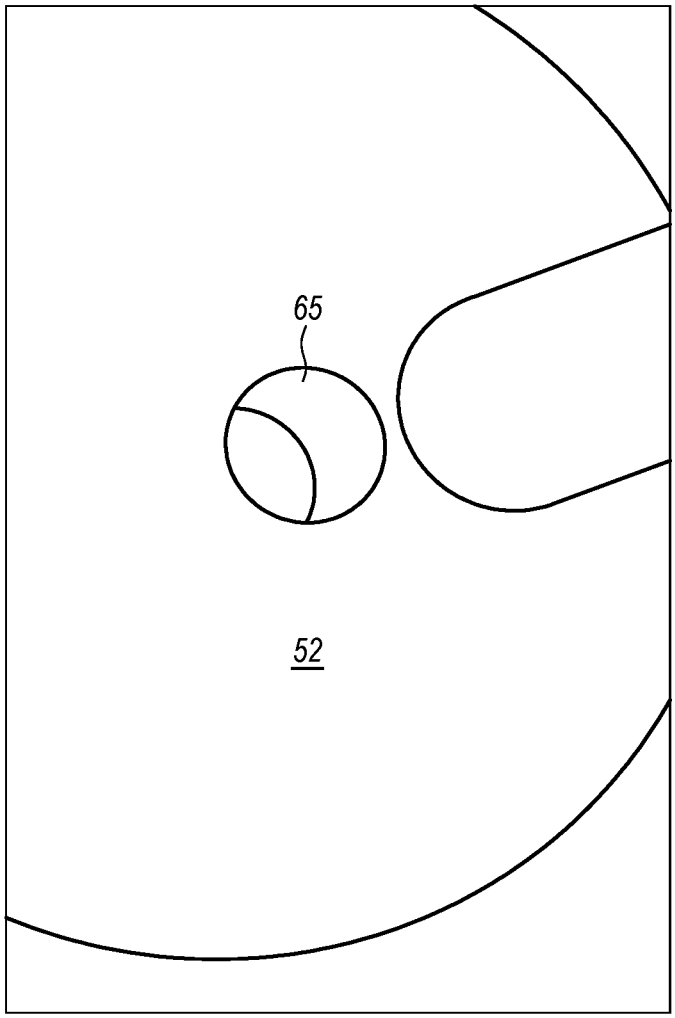
FIG. 7 illustrates a close up view of the barrel stopper from the dispensing apparatus of the present invention.

With regard to FIG. 7, shown is a close up of the T-piece hole 65 in the circular piece 52 illustrating the. beveled edge of the hole in order for the smaller 0-ring to it snuggly.

Figure 8A:
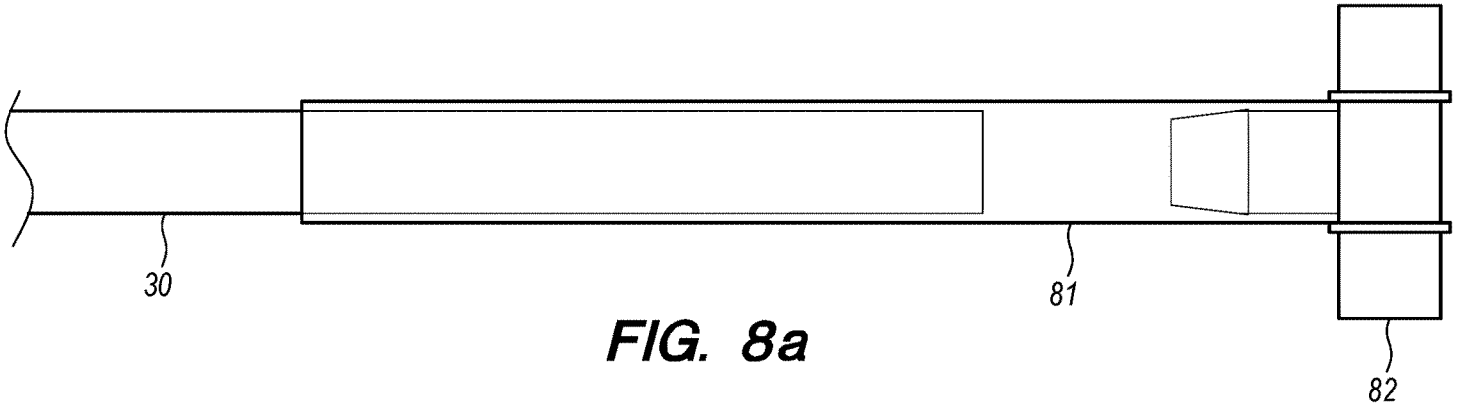
FIGS. 8*a* and 8*b* illustrate the telescoping end of the dispensing apparatus of the present invention.
Figure 8B:
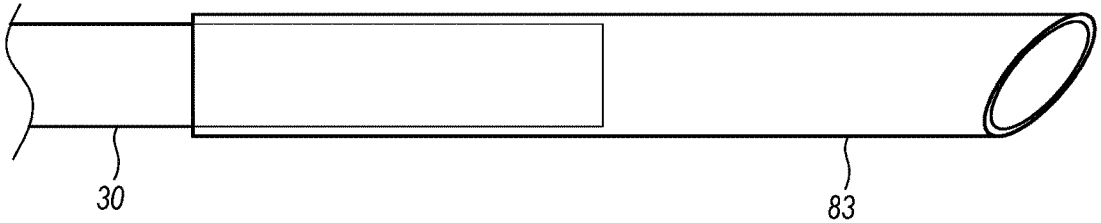

With regard to FIGS. 8*a* and 8*b*, shown are two examples of a telescoping extension 81, 83 attached to the barrel end of the beverage pipe 30. When inserting the beverage pipe into the barrel, the extension is positioned so that it hits the bottom of the barrel and slides up the beverage pipe until the connector unit is tightened. This ensures that the liquid is drawn from the bottom of the barrel so that the barrel is finally emptied.

In the first embodiment, the present invention provides a simple apparatus for dispensing an alcoholic beverage directly from a barrel.

In another embodiment, the present invention provides an apparatus for dispensing an alcoholic beverage from a barrel that is easy to use and easy to sterilize. In a preferred embodiment the dispensing apparatus is comprised of entirely food grade parts resulting in the apparatus being hygienic.

In still another embodiment, the present invention provides an apparatus fur dispensing an alcoholic beverage from a barrel wherein the bung hole of the barrel is sealed air tight preventing the spoilage of an alcoholic beverage from oxygen and/or debris.

In another embodiment, the present invention provides an apparatus for dispensing an alcoholic beverage from a barrel that is simple to install and uninstall.

In yet another embodiment, the present invention provides an apparatus for dispensing an alcoholic beverage from a barrel having a telescoping pipe allowing for dispensing of an alcoholic beverage down to the bottom of the barrel.

In a further embodiment, the present invention provides a dispensing apparatus for dispensing an alcoholic beverage from a barrel In a further still embodiment, the present invention provides a method of installing an alcoholic beverage barrel dispensing apparatus, the method comprising:

a) removing the wing nut from the T-piece the dispensing apparatus;

b) removing the stainless steel washer between the wing nut and tube;

c) removing the tube covering the T-piece;

d) replacing the wing nut on the T-piece to prevent the T-piece from falling through the circular piece hole into the barrel;

e) sliding the small O-ring to underneath the wing nut and allowing the T-piece to fall through the hole until it is stopped by the small O-ring & wing nut;

f) inserting the alcoholic beverage pipe at the required angle into the bung hole of an alcoholic beverage barrel so that the horizontal end of the T-piece is inserted through the bung hole;

g) pulling the wing nut up and sliding the O-ring back to the circular piece;

h) removing the wing nut from the T-piece;

i) replacing the lower stainless steel washer and then the tube covering the T-piece;

j) replacing the top stainless steel washer;

k) replacing the wing nut on the T-piece and tighten until the bung hole is sealed tightly;

l) attaching the in gas line and turn pressure on to about 5 psi; and m) opening the alcoholic beverage faucet to start the flow of alcoholic beverage through the alcoholic beverage pipe.

The foregoing detailed description is not to be taken in a limiting sense, and the scope of the present invention is defined by the appended claims and their equivalents. Although several embodiments have been presented, one skilled in the art will appreciate that various modifications are possible. Such variations will not materially alter the nature of the invention. Many embodiments may be conceived and may not achieve all the advantages of some embodiments, particularly preferred embodiments, yet the absence of a particular advantage shall not be construed to necessarily mean that such an embodiment is outside the scope of the present invention.

The invention claimed is:

1. An apparatus for dispensing an alcoholic beverage directly from a barrel, the apparatus comprising:

a) a beverage pipe, wherein the beverage pipe is inserted into the barrel;

b) a connector unit; and c) a sight glass;

wherein the connector unit is further comprised of a stainless steel central piece wherein a T-piece passes through a central hole in the central piece;

wherein the T-piece passes through the following components in order: a small O-ring, a first stainless steel washer, a stainless steel tube, a second stainless steel washer and a stainless steel wing nut.

2. The apparatus of claim 1 wherein the central piece further includes a first hole and a second hole, the first hole located on one side of the central hole and the second hole located opposite the first hole and on the alternate side of the central hole wherein through the first hole passes the beverage pipe and through the second hole passes an air flow control valve.

3. The apparatus of claim 2 wherein the air flow control valve controls the flow of inert gas into the barrel at a low pressure thereby displacing the alcoholic beverage from the barrel though the beverage pipe.

4. The apparatus of claim 1, wherein the central piece further comprises a central channel having a large O-ring wherein the large O-ring fits snuggly into a bung hole of a barrel.

5. The apparatus of claim 1 wherein tightening of the wing nut forces first washer to squeeze the small O-ring against the hole in the central hole of the circular piece thereby forming an air tight seal around the central hole.

6. The apparatus of claim 1 wherein the sight glass is positioned at the upper most end of the beverage pipe adjacent to a dispensing faucet.

7. The apparatus of claim 6 wherein the opening of the faucet opens a safety valve located in the beverage pipe thereby starting the flow of the alcoholic beverage, the alcoholic beverage passing through the sight glass and into a serving container.

8. A method of installing the alcoholic beverage barrel dispensing apparatus of claim 5, the method comprising:

a) obtaining the apparatus of claim 5;

b) removing the wing nut from the T-piece of the dispensing apparatus;

c) removing the stainless steel washer between the wing nut and tube;

d) removing the tube covering the T-piece;

e) replacing the wing nut on the T-piece to prevent the T-piece from falling through the central hole of the circular piece into the barrel;

f) sliding the small O-ring to underneath the wing nut and allowing the T-piece to fall through the hole until the T-piece is stopped by the small O-ring & wing nut;

g) inserting the alcoholic beverage pipe into a bung hole of an alcoholic beverage barrel so that the horizontal end of the T-piece is inserted through the bung hole;

h) pulling the wing nut up and sliding the O-ring back to the circular piece;

i) removing the wing nut from the T-piece;

j) replacing the lower stainless steel washer and then the tube covering the T-piece;

k) replacing the top stainless steel washer;

l) replacing the wing nut on the T-piece and tighten until the bung hole is sealed tightly;

m) attaching the inert gas line and turn pressure on to about 5 psi; and n) opening an alcoholic beverage faucet to start the flow of alcoholic beverage through the alcoholic beverage pipe.

* * * * *